US007066216B2

(12) United States Patent
Sato et al.

(10) Patent No.: US 7,066,216 B2
(45) Date of Patent: Jun. 27, 2006

(54) SYSTEM FOR ALLOCATING FUEL STATIONS TO MOVABLE BODIES

(75) Inventors: Kazuhisa Sato, Saitama (JP); Hiroyuki Abe, Saitama (JP); Junichi Kobayashi, Saitama (JP); Toshiaki Takeshita, Saitama (JP); Hisashi Nagaoka, Saitama (JP); Masanori Hayashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/252,431

(22) Filed: Oct. 17, 2005

(65) Prior Publication Data

US 2006/0086406 A1 Apr. 27, 2006

(30) Foreign Application Priority Data

Oct. 22, 2004 (JP) ..... 2004-307700
Mar. 14, 2005 (JP) ..... 2005-070836

(51) Int. Cl.
*B65B 1/04* (2006.01)

(52) U.S. Cl. ..... 141/94; 141/231; 701/123; 700/232

(58) Field of Classification Search ..... 141/94, 141/192, 198, 231; 700/232, 236; 701/123
See application file for complete search history.

(56) References Cited

U.S. PATENT DOCUMENTS 5,400,253 A * 3/1995 O'Connor ..... 701/123
6,367,516 B1 * 4/2002 Christman et al. ..... 141/1
6,691,025 B1 * 2/2004 Reimer ..... 701/123

FOREIGN PATENT DOCUMENTS

JP 2004-192863 7/2004

* cited by examiner

*Primary Examiner*—Steven O. Douglas
(74) *Attorney, Agent, or Firm*—Fish & Richardson P.C.

(57) ABSTRACT

A system for allocating fuel stations to movable bodies includes an onboard unit, a station unit and a server. The onboard unit stores and updates information about a movable body. The station unit disposed at a fuel station which supplies fuel to the movable body stores and updates information about the fuel station. The server, which is connected to the onboard unit and the station unit through networks, allocates certain fuel stations to the movable body which requires fueling, based on the information about the movable body and the fuel station. When a difference of distance resulting from a subtraction, a movable distance minus a station distance, is smaller than a certain threshold, the server determines a necessity of supplying fuel to the movable body, allocating a fuel station which keeps an amount of stored fuel necessary for fuelling the movable body.

6 Claims, 13 Drawing Sheets

SYSTEM FOR ALLOCATING FUEL STATIONS TO MOVABLE BODIES

The present invention relates to a system for allocating fuel stations to movable bodies which require fueling.

Power sources such as a fuel cell and a hydrogen engine have been attracting considerable attention recently. It appears reasonable to assume that a large-scale hydrogen gas station is unlikely to occupy a mainstream position in the beginning when a hydrogen vehicle makes its debut, taking into account profit (cost performance). Accordingly, it is expected that charging the hydrogen vehicle with hydrogen gas will be carried out by a low number of hydrogen stations, which are operated on a small scale.

In order to cope with the possible situation described above, several measures have been proposed. For example, a patent document 1 discloses a control system for a fuel cell vehicle, which is able to provide a user with a position of a hydrogen gas station, which the user can reach departing from a current position of the fuel cell vehicle. The system selects this hydrogen gas station based on a position of the fuel cell vehicle, positions of hydrogen gas stations and a drivable distance which is predicted based on an amount of remaining hydrogen gas and a mileage.

Patent document 1: Japanese Published Patent Application 2004-192863 (paragraphs 0105–0107 and FIG. 1)

In this connection, there is some concern that a small-scale hydrogen gas station would be unable to have sufficient capacity to charge all hydrogen vehicles with hydrogen gas, which visit the station for fueling. Although the station is operated on a small scale, it is none the less requested to be capable of serving the hydrogen vehicles without interruption.

The technique disclosed in the patent document 1 does not provide a solution for a problem described above. A fuel cell vehicle in the patent document 1 is likely to suffer an incident where it is not charged with hydrogen gas even if it visits a hydrogen gas station, which is indicated as an allocated station with its position. This is attributed to the fact that the control system does not have information such as an amount of stored hydrogen gas and production capability of the hydrogen gas station as well as amounts of remaining fuel for other hydrogen vehicles. In addition, displaying only the information about position of the hydrogen station may make a user feel uneasy, who is accustomed to an alarm lamp of a gasoline vehicle.

SUMMARY OF THE INVENTION

The present invention seeks to provide a system which allows a user of a vehicle to drive feeling at ease even under unsatisfactory conditions that infrastructures associated with fueling have not yet matured and each infrastructure is operated on a small scale, hydrogen gas stations, for example.

It is an aspect of the present invention to provide a system for allocating fuel stations to movable bodies, which comprises an onboard unit, a station unit and a server. The onboard unit, which is mounted on a movable body, stores and updates information about the movable body. The station unit disposed at a fuel station which supplies fuel to the movable body stores and updates information about the fuel station. The server, which is connected to the onboard unit and the station unit through networks, allocates certain fuel stations to the movable body which requires fueling, based on the information about the movable body received from the onboard unit and the information about the fuel station received from the station unit. The information about the movable body comprises an amount of remaining fuel and a position of the movable body. The information about the fuel station comprises an amount of stored fuel and a position of the fuel station. The server calculates not only a movable distance for the movable body based on information comprising the amount of remaining fuel, but also a station distance, which represents a distance between the movable body and the fuel station, based on the positions of the movable body and the fuel station. When a difference of distance resulting from a subtraction, the movable distance minus the station distance, is smaller than a certain threshold, the server determines a necessity of supplying fuel to the movable body, allocating a fuel station which keeps an amount of stored fuel necessary for fuelling the movable body.

It is another aspect of the present invention to provide a system for allocating fuel stations to movable bodies, which further comprises a display unit. The server transmits information about allocation of the fuel station to the onboard unit. The onboard unit is connected to the display unit, and when the onboard unit receives the information from the server, the onboard unit indicates the information on the display unit.

It is still another aspect of the present invention to provide a system for allocating fuel stations to movable bodies, in which when number of fuel stations which the server allocates to the movable body is smaller than a certain threshold, the onboard unit indicates an alarm for fuel shortage on the display unit.

It is yet another aspect of the present invention to provide a system for allocating fuel stations to movable bodies, which further comprises a fuel unit for producing fuel. When the server is not able to allocate the fuel station which keeps the amount of stored fuel necessary for fuelling the movable body whereas the difference of distance is smaller than the certain threshold, the server transmits a message commanding production of fuel to the station unit. The station unit is connected to the fuel unit, and when the station unit receives the message from the server, the station unit starts the fuel unit producing fuel.

It is a further aspect of the present invention to provide a system for allocating fuel stations to movable bodies, in which the information about the movable body further comprises a destination of the movable body. The server searches for a route extending from a position of the movable body to a destination thereof, so that the server not only allocates one or more fuel stations to the movable body based on the route, a distance of the route, the position of the fuel station and the movable distance, but also settles order of priority for fueling the movable body at each fuel station.

It is a still further aspect of the present invention to provide a system for allocating fuel stations to movable bodies, which further comprises a display unit. The display unit is connected to the onboard unit mounted on the movable body, and displays one of an alarm for fuel shortage and information about allocation of a fuel station which the onboard unit has received from the server.

As described above, the system allocates fuel stations, which have a necessary amount of stored fuel, to movable bodies, taking into account information about both movable bodies and fuel stations. In this way, it is possible for the system to let a user feel assured and relived in driving, even if infrastructures have not yet been sufficiently developed and each infrastructure is operated on a small scale, a hydrogen gas station, for example.

Furthermore, because the system according to the present invention indicates information about allocation of fuel stations on the display, the user is able to visually know the fuel stations at which the user is provided with fuel.

Because the system according to the present invention indicates an alarm for fuel shortage when number of fuel stations allocated to a movable body is less than a certain value, it is possible to advise a user to immediately fuel his vehicle.

Because a fuel station produces fuel when the system according to the present invention is not able to allocate fuel stations to a movable body, it is possible to provide secure fuelling to the movable body.

Because the system according to the present invention is able to allocate appropriate fuel stations to a movable body, it is not necessary for a user to take a roundabout route to reach a fuel station. In this way, the system decreases troublesomeness for the user.

Because the system according to the present invention indicates information about allocation of fuel stations and an alarm for fuel shortage on a display of a movable body, it makes a user feel more assured in driving.

DESCRIPTION OF THE PREFERRED EMBODIMENTS

Figure 1:
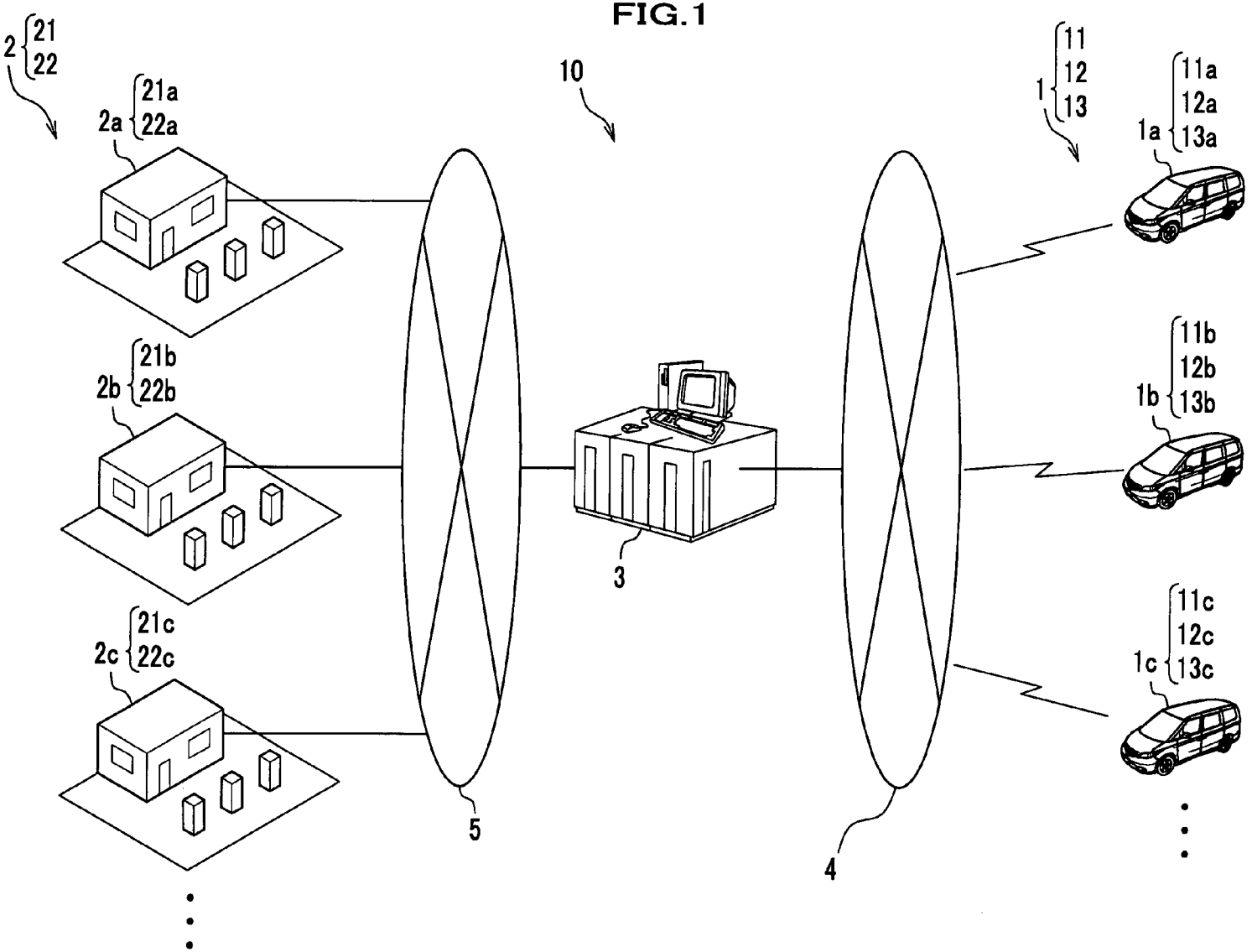
FIG. 1 is a schematic diagram illustrating a system for allocating fuel stations to movable bodies according to the present invention.

Description is now given of an embodiment of the present invention with reference to drawings.

A system 10 for allocating fuel stations to movable bodies comprises hydrogen vehicles, which correspond to movable bodies in the appended claims and hereinafter referred to as vehicles 1, a server 3 and hydrogen gas stations, which correspond to fuel stations in the appended claims and are hereinafter referred to as filling stations 2. The vehicles 1, filling stations 2 and server 3 are connected through communication networks 4 and 5. The vehicles 1 are connected to the server 3 via the communication network 4, which is provided in the form of a wireless network. Similarly, the filling stations 2 are connected to the server 3 via the communication network 5, which is provided in the form of one of cable and wireless networks. The communication networks 4 and 5 are preferably but not necessarily adapted to be dedicated lines, but they may be alternatively public lines such as internets.

A vehicle 1 stores vehicle information about itself, such as an amount of remaining hydrogen gas and a current position, and updates it whenever need arises. When the vehicle 1 receives a request for transmission of vehicle information, the vehicle 1 transmits latest vehicle information to the server 3. When the vehicle 1 receives an allocation of filling stations or an alarming message from the server 3, the vehicle 1 notifies a driver of it by a screen 12 of car navigation or a lamp 13 for fuel alarm. In this connection, the screen 12 and the lamp 13 correspond to the display in the appended claims, respectively. Furthermore, when the vehicle 1 experiences an emergency of fuel shortage, it transmits a message reporting an emergency to the server 3, so that it is given an allocation of filling stations 2 by the server 3. Functions carried out on the vehicle 1 described above are executed by a computer 11, which is referred to as the onboard unit in the appended claims.

A filling station 2 is a station for supplying hydrogen gas, which stores station information, such as its stored amount of hydrogen gas and position, and updates the station information whenever need arises. When the filling station 2 receives a request for transmission of station information from the server 3, it transmits latest station information to the server 3. In addition, when the filling station 2 receives a reservation for filling hydrogen gas from a vehicle 1, this reservation is incorporated into the station information. Functions carries out at the filling station 2 described above are implemented by a computer 21, which is referred to as the station unit in the appended claims. A unit 22 for producing hydrogen gas (a fuel unit for producing fuel in the appended claims) is connected to the filling station 2.

As the vehicles 1 and filling stations 2 are meant to collectively name hydrogen vehicles and stations for filling hydrogen gas, subscripts are used when they are required to be individually identified. For example, they are represented like a vehicle 1*a*, a vehicle 1*b* and the like, and a filling station 2*a*, a filling station 2*b* and the like. So are the computer 11, screen 12, lamp 13, computer 21 and unit 22 like a computer 11*a*, a computer 11*b* and the like, a screen 12*a*, a screen 12*b* and the like, a lamp 13*a*, a lamp 13*b* and the like, a computer 21*a*, a computer 21*b* and the like, and a unit 22*a*, a unit 22*b* and the like, respectively.

The server 3 is a computer serving as a centralized control host in the system 10 for allocating fuel stations to movable bodies, which is implemented by a personal computer (PC), for example. The server 3 transmits a request for transmission of vehicle information to a vehicle 1 and a request for transmission of station information to a filling station 2 at certain time intervals. The server 3 allocates filling stations 2 to the vehicle 1, transmitting results of allocation and a message conveying an alarm for fuel shortage to the vehicle 1. Furthermore, if the server 3 receives a message conveying fuel shortage from a vehicle 1, it allocates filling stations 2 to the vehicle 1, transmitting results of allocation to the vehicle 1. In this connection, it may be possible to dispose the server 3 remotely from vehicles 1 and filling stations 2, as shown in FIG. 1. It may be alternatively possible to dispose the server 3 at a vehicle 1 or a filling station 2. When the server 3 is disposed at the vehicle 1, the communication network 5 is established through a wireless network.

Figure 2:
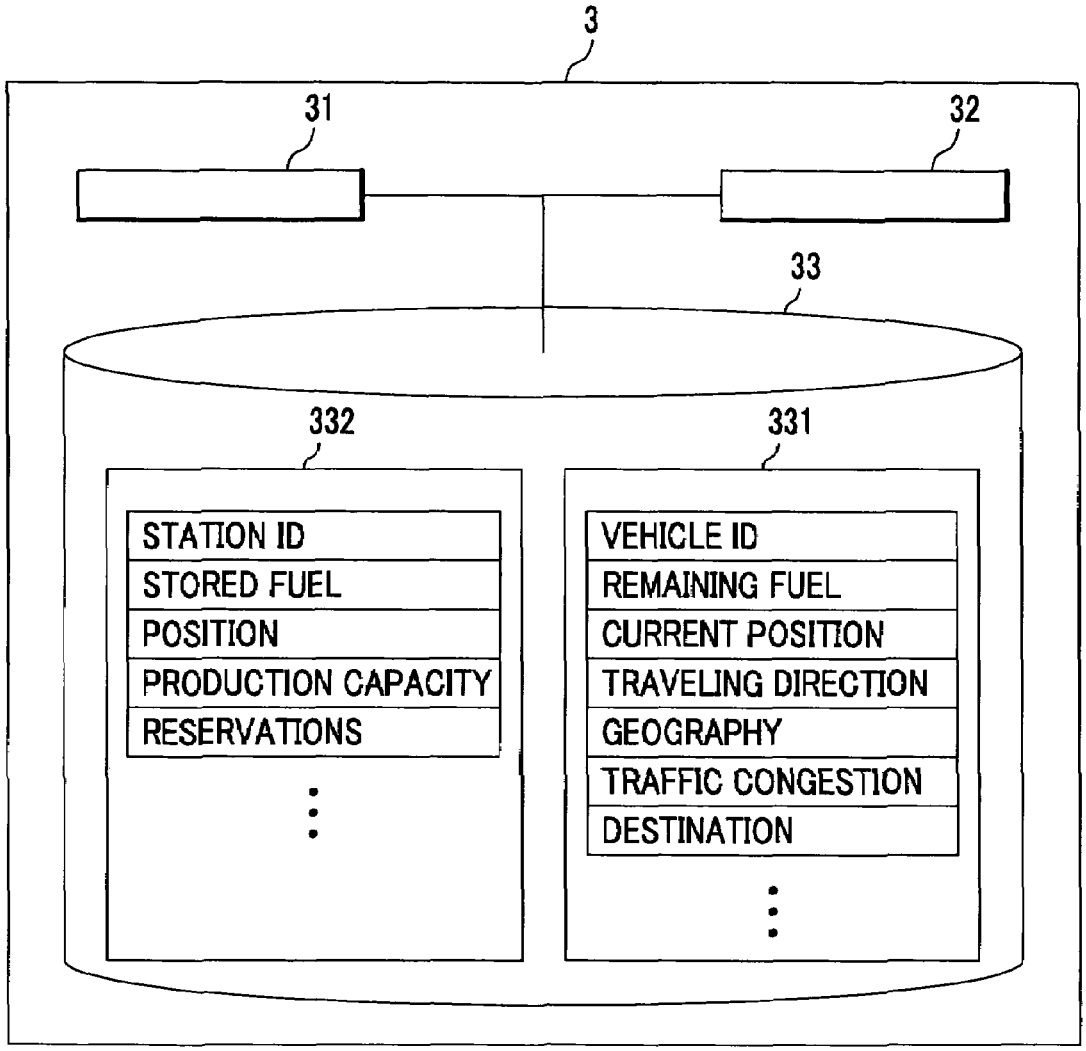
FIG. 2 is a schematic diagram illustrating a server according to the present invention.

Description is given of a setup of the server with reference to FIG. 2 as well as FIG. 1 if necessary. The server 3 includes a main control unit 31, a communication unit 32 and a memory unit 33. The main control unit 31, which is responsible for carrying out overall control of the server 3, has a central process unit (CPU) and a memory. The CPU executes programs stored in the memory, so that the main control unit 31 controls the server 3 so as to implement its proper functions. The communication unit 32 is responsible for communication not only between the server 3 and vehicles 1 but also between the server 3 and filling stations 2. Network connecting devices are used for the communication unit 32, for example. Though the server 3 has only a set of communication unit 32 as shown in FIG. 2, it may be alternatively possible to adopt two sets, one for the communication network 4 used for the vehicles 1 and the other for communication network 5 used for the filling stations 2. The memory unit 33, which stores necessary information so that the main control unit 31 controls the server 3, is implemented by a nonvolatile memory device such as a hard disk, for example. The memory unit 33 includes a data base 331 for vehicle information and a data base 332 for station information.

The data base 331 stores vehicle information about the vehicles 1. The vehicle information, which is transmitted from the vehicles 1, enters the data base 331 to be stored through the communication network 4 and the communication unit 32. This information includes vehicle identification (ID), an amount of remaining fuel, a current position, a traveling direction, geography, traffic congestion and a destination. The vehicle ID is a number uniquely assigned to each vehicle 2, and symbols such as 1*a*, 1*b* and the like are adopted in the embodiment. The amount of remaining fuel is meant to represent an amount of fuel remaining in a vehicle 1 at a particular time. The current position, which is referred to as a position of the movable body in the appended claims, represents a position of the vehicle 1 at a particular time, such as latitude and longitude measured by global positioning systems (GPS).

The traveling direction, which literally represents a direction in which the vehicle 1 is traveling, is one of reference data based on which filling stations 2 are allocated to the vehicle 1. More specifically speaking, the filling stations 2 which stand along the traveling direction of the vehicle 1 as close as possible are allocated to the vehicle 1. The geography includes conditions of a road on which the vehicle 1 is traveling, such as a slope with respect to forward-backward direction of the vehicle 1. This supplies information if the road is level, uphill or downhill. The traffic congestion indicates traffic conditions of the road on which the vehicle 1 is traveling, including a speed of the vehicle 1 and a frequency in depressing its brake, for example. This provides information about how bad the traffic congestion is. It is possible to estimate a mileage of the vehicle 1 based on the geography and traffic congestion. The destination (a destination of the movable body in the appended claims) shows a destination of the vehicle 1, which is one of reference data for allocating the filling stations 2 to the vehicle 1. For example, the filling stations 2 standing along a route of the vehicle 1 as close as possible, which extends from the current position to the destination, are allocated to the vehicle 1.

The data base 332 stores station information for the filling stations 2. This station information transmitted from the filling stations 2 enters the data base 332 through the communication network 5 and communication unit 32, and is stored. This information includes station identification (ID), an amount of stored fuel, a position, capacity of production and reservations. The station ID is a number uniquely assigned to each filling station 2, and symbols such as 2*a*, 2*b* and the like are used in the embodiment. The amount of stored fuel indicates an amount of hydrogen gas stored by a filling station 2 at a particular time. The position (a position of the fuel station in the appended claims) shows a position of the filling station 2, such as latitude and longitude measured by GPS. The capacity of production represents an amount of hydrogen gas which the filling station 2 is able to produce per hour. In this connection, the position and the capacity of production, which are intrinsically related to the filling station 2, will not vary often. Accordingly, as long as there are no variations after storing the information associated with the filling station 2 into the data base 332, it may not be necessary to update the station information.

The reservations provide a status of reservations for fuelling at the filling station 2, which includes vehicle ID's of reserved vehicles 1, reserved volume of hydrogen gas and reserved time for fueling. It may be possible to arbitrarily select methods for making a reservation, which is made by a vehicle 1 directly accessing to a filling station 2. One example for the methods is communication carried out by computers between the vehicle 1 and the filling station 2. Another example is that a passenger in the vehicle 1 makes contact with a person at the filling station 2 by a communication method, a cell phone or email, for example, so that the person updates the status of reservations stored in a computer a. FIRST EMBODIMENT

Figure 3:
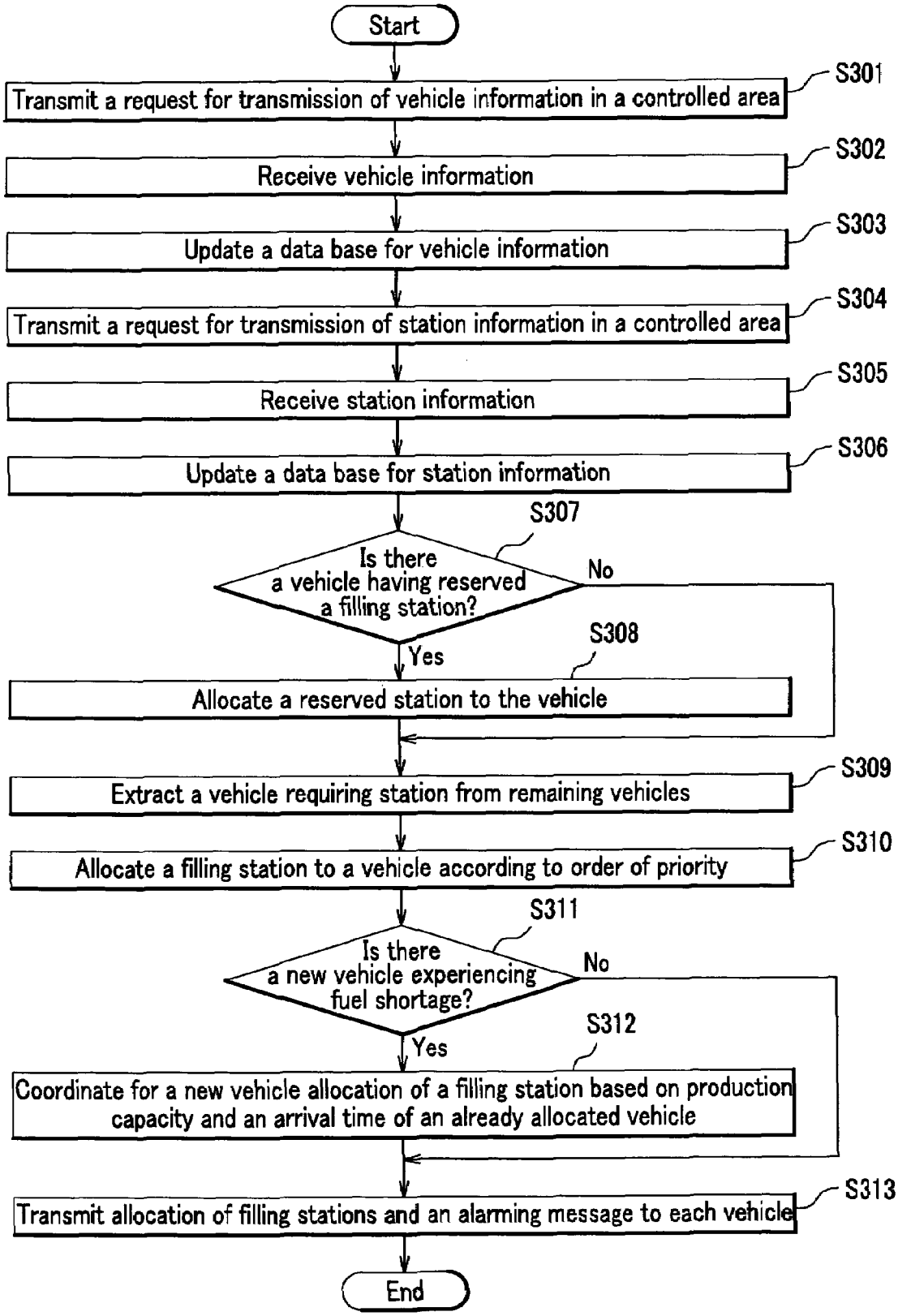
FIG. 3 is a flow chart showing main steps carried out by a server according to the present invention.

Description is given of steps carried out by a system for allocating fuel stations to movable bodies according to the present invention with reference to FIGS. 3 to 5, and FIGS. 1 and 2 if necessary. As explanation of steps carried out in a server 3 gives overall view for the system, emphasis is given to explanation of these steps. FIG. 3 is a flow chart showing main steps carried out in a server according to the present invention, which are applicable to both first and second embodiments. The server 3 executes these main steps at regular intervals so as to bring a system 10 into effect, which allocates filling stations 2 to vehicles 1 that require charging of hydrogen gas. Though description is given of the server 3 below, which is regarded for convenience sake as a unit that carries out the steps, the following units virtually take part in execution of these steps. For example, a control unit 31 provides overall control for the server 3. Communication between vehicles 1 and filling stations 2 is carried out through a communication unit 32. When the server 3 accesses a data base 331 for vehicle information and a data base 332 for station information, the server 3 interacts with a memory unit 33 for input and output (readout and writing of data).

The server 3 transmits a request (message) for transmission of vehicle information in an area (geographical area), which is under the control of the server 3 (step S301). In this connection, the area is meant to represent a geographical area, which is defined by a circular area with a certain radius, for example. The server 3 transmits the request with a radio wave, which is adjusted to cover the geographical area. The server 3 receives vehicle information from a vehicle 1, which has received the request (step S302). The server 3 updates the data base 331 based on the received vehicle information (step S303). When the server 3 carries out updating, it refers to a vehicle ID in the vehicle information.

The server 3 transmits a request (message) for transmission of station information to an area, which is under the control of the server 3 (step S304). The area is meant to represent a geographical area, which is defined by a circular area with a certain radius, for example. When a communication network 5 is wireless, the server 3 transmits the request with a radio wave, which is adjusted to cover the geographical area. In contrast, when the communication network 5 employs wire communication, network addresses, such as internet protocol (IP) addresses, are obtained in advance for filling stations 2 located within the area. The server 3 conducts multi-cast to these network addresses. The server 3 receives station information from a station 2, which has received the request (step S305). The server 3 updates the data base 332 based on the received station information (step S306). When the server 3 carries out updating, it refers to a station ID.

Having conducted the steps described above, the server 3 finishes storing latest vehicle and station information in the data bases 331 and 332, which is under the control of the server 3.

The server 3 investigates whether or not there is a vehicle 1 which has made a reservation for a filling station 2 (step S307). More specifically speaking, the server 3 retrieves the database 332 to check whether or not a vehicle ID of the vehicle 1 is filed in a reservation status. If there is the vehicle 1 reserved for the filling station 2 (YES in step S307), the server 3 allocates the reserved station 2 to the vehicle 1 (step S308). "Allocation of a filling station 2 to a vehicle 1" means that the server 3 establishes not only a station ID of the allocated filling station 2 for the vehicle information about the vehicle 1, which is stored in the data base 331, but also a vehicle ID of the vehicle 1 and an amount of reserved fuel for the station information about the filling station 2, which is stored in the data base 332. If there is no vehicle 1 reserved for the filling station 2 (NO in step S307), the server 3 skips step S308.

The server 3 extracts a vehicle 1, which requires allocation of a filling station 2, from remaining vehicles 1 which have not made reservations for filling stations 2 (step S309). The server 3 carries out the following steps so as to determine whether or not the vehicle 1 requires allocation of the filling station 2. The server 3 reads an amount of remaining fuel, geography and traffic congestion from the data base 331, calculating a mileage based on the geography and traffic congestion. Based on this mileage and the amount of remaining fuel, the server 3 calculates a movable distance for the vehicle 1. Subsequently, reading a position of the vehicle 1 from the data base 331 and a position for each of the filling stations 2 from the data base 332, the server 3 calculates a minimum station distance (station distance in the appended claims) between the vehicle 1 and a closest filling station 2. If a value (differential distance) defined by a subtraction, a movable distance minus a minimum station distance, is smaller than a certain threshold, the server 3 determines that allocation of the filling station 2 is necessary for the vehicle 1. In this connection, it may be possible for the sever 3 to determine the necessity when the differential distance is less than or equal to the threshold. In addition, it is not mandatory to select the minimum station distance with respect to the closest filling station, but it may be alternatively possible to use a distance between the vehicle 1 and another filling station 2 which stands at an appropriate position in terms of a traveling direction of the vehicle 1.

Of vehicles 1 which are selected in the steps described above, the server 3 allocates a filling station 2 to a vehicle 1 according to order of priority (step S310). "Order of priority" is adjusted so that the smaller a differential distance calculated in step S309 is, the greater magnitude of priority is given. This is ascribed to the fact that the smaller the differential distance is, the fewer margin for an amount of remaining fuel, which is necessary for reaching a closest filling station 2, a vehicle 1 possesses. Description in detail is given of steps for allocating a filling station will be described later. Carrying out the steps described above, the server 3 finishes allocating a filling station 2 to a vehicle 1 for the present.

The server 3 investigates whether or not it has received a message conveying fuel shortage from a new vehicle 1, which has come into an area under the control of the server 3 (step S311). This step is intended for coping with the fuel shortage of the new vehicle 1 in addition to the vehicle 1 from which the server 3 has received the vehicle information in step S302. If the server 3 has received this message (YES in step S311), the server 3 coordinates for the new vehicle 1 allocation of a filling station 2, which the new vehicle 1 is able to reach, based on the capacity of production possessed by the filling station 2 and an arrival time of the vehicle 1 to which the filling station 2 has already been allocated (step S312). Description in detail is given of steps for allocating a filling station will be described later. If the server 3 has not received this message (NO in step S311), it skips step S312.

The sever 3 transmits allocation of filling stations 2 and a message alerting each vehicle 1 to fuel shortage (step S313). More specifically speaking, the server 3 first transmits the allocation of filling stations 2. When number of filling stations 2 allocated to a vehicle 1 is smaller than a certain threshold, the server 3 further transmits the message alarming fuel shortage. If two is assumed to be selected for the threshold, the server 3 transmits a message alarming fuel shortage when the number of filling stations 2 happens to be one. The message is intended to alert the vehicle 1 to an emergency that only one filling station 2 is available for the vehicle 1. In this connection, it may be alternatively possible for the server 3 to transmit the message alarming fuel shortage when the number of filling stations 2 allocated to the vehicle 1 is smaller than or equal to the certain threshold. The vehicle 1 which has received the allocation displays it on a screen of car navigation and the like (display unit in the appended claims). Furthermore, the vehicle 1, which has received the message alarming fuel shortage, turns on a lamp alarming fuel shortage (display unit in the appended claims) in a meter panel. It may be alternatively possible to display a movable distance according to an amount of remaining fuel.

Receiving the information from the server 3 as described above, a driver and a passenger in the vehicle 1 are able to know not only the filling stations 2 available for having supply of hydrogen gas, but also an emergency by the alarming lamp turned on. In addition, because he knows the emergency caused by fuel shortage by the alarming lamp, the driver who is accustomed to a gasoline vehicle will not experience unfamiliarity.

It may be alternatively possible to adopt different methods for indicating an alarm in the vehicle 1 which has received a message alerting to fuel shortage. For example, it may be possible to turn on an alarming lamp with a different color or to flash it on and off so as to distinguish its lighting from an occasion of emptied fuel. It may also be possible to adopt one of vocal notification, email and a readout function of email, which are implemented by one of a car navigation device, a cellular phone and the like.

Figure 4:
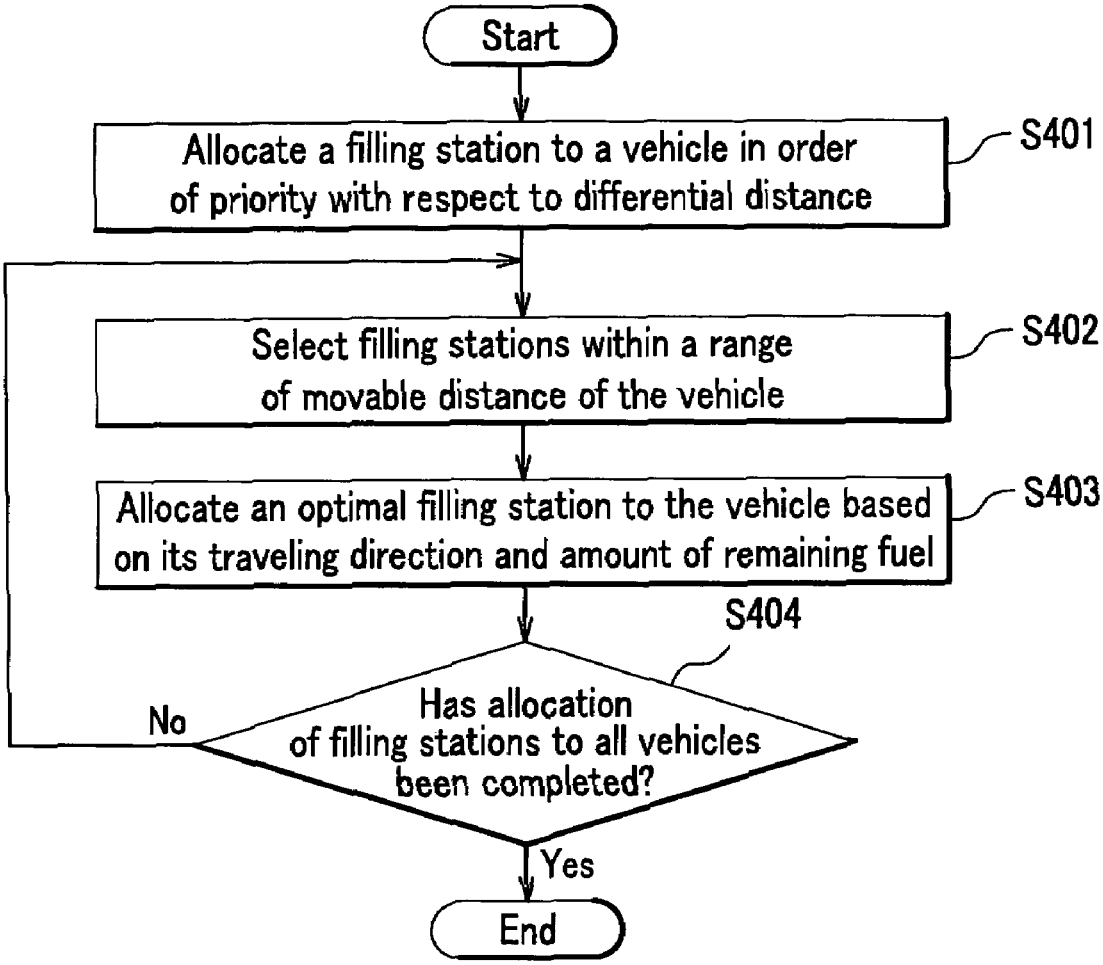
FIG. 4 is a flow chart showing steps applied to allocation of filling stations carried out by a server according to the present invention.

FIG. 4 is a flow chart showing steps applied to allocation of filling stations carried out by a server. These steps describe details for step S310 shown in FIG. 3. The server 3 starts allocating filling stations 2 to vehicles 1 according to order of priority. Namely the server 3 first allocates filling stations 2 to a vehicle 1 which has a smallest differential distance, and continues allocation to other vehicles 1 in order of priority (step S401). The sever 3 specifies a vehicle 1 according to order of priority, to which a filling station 2 should be allocated, selecting filling stations 2 which are located within a range of movable distance of the vehicle 1 (step S402). More specifically speaking, the server 3 determines the range based on a current position of the vehicle 1 which is read out from the data base 331 for vehicle information, and a movable distance of the vehicle 1 which has been calculated in the step described above. Retrieving the data base 332 for station information, the server 3 extracts the filling stations 2 which are located within the range.

Subsequently, narrowing the extracted filling stations 2 to an optimal one based on a traveling direction of the vehicle 1 and its amount of remaining fuel, the server 3 allocates it to the vehicle 1 (step S403). More specifically speaking, the server 3 reads out from the data base 332 an amount of stored fuel, reservations, information about the vehicle 1 (see the description of step S308) for the filling stations 2 one after another, in order of their closeness with respect to a traveling direction of the vehicle 1. The server 3 checks whether or not an effective amount of stored fuel, which is defined by a subtraction, an amount of stored fuel minus an aggregate amount of reserved fuel, is equal to or greater than a minimum amount of fuel required for the vehicle 1. This effective amount of stored fuel corresponds to an amount of fuel available for a new corner, the vehicle 1. If the effective amount of stored fuel is equal to or greater than the minimum amount, the server 3 assigns the vehicle 1 to a filling station 2. If the effective amount of stored fuel is less than the minimum amount, the server 3 moves on to a next filling station 2. In this connection, the minimum amount of fuel is meant to represent an amount of fuel with which the vehicle 1 is able to reach another filling station 2 subsequent to one filling station 2 at which the vehicle 1 has supply of hydrogen gas.

If all the filling stations 2 which the server 3 has extracted do not successfully pass checking of an amount of fuel, the server 3 proceeds to coordination, reconsidering allocation of filling stations 2 and commanding them production of hydrogen gas. Detailed description of steps associated with coordination will be given in explanation of FIG. 5, which describes similar steps. The server 3 checks whether or not it has completed allocation of filling stations 2 to vehicles 1 which the server 3 has extracted (step S404). If allocation has not been completed (NO in step S404), the server 3 selects a next vehicle 1 to be allocated filling stations 2 and carries out steps S402 and S403. If allocation has been completed (YES in step S404), the server 3 finishes steps for allocating filling stations.

Figure 5:
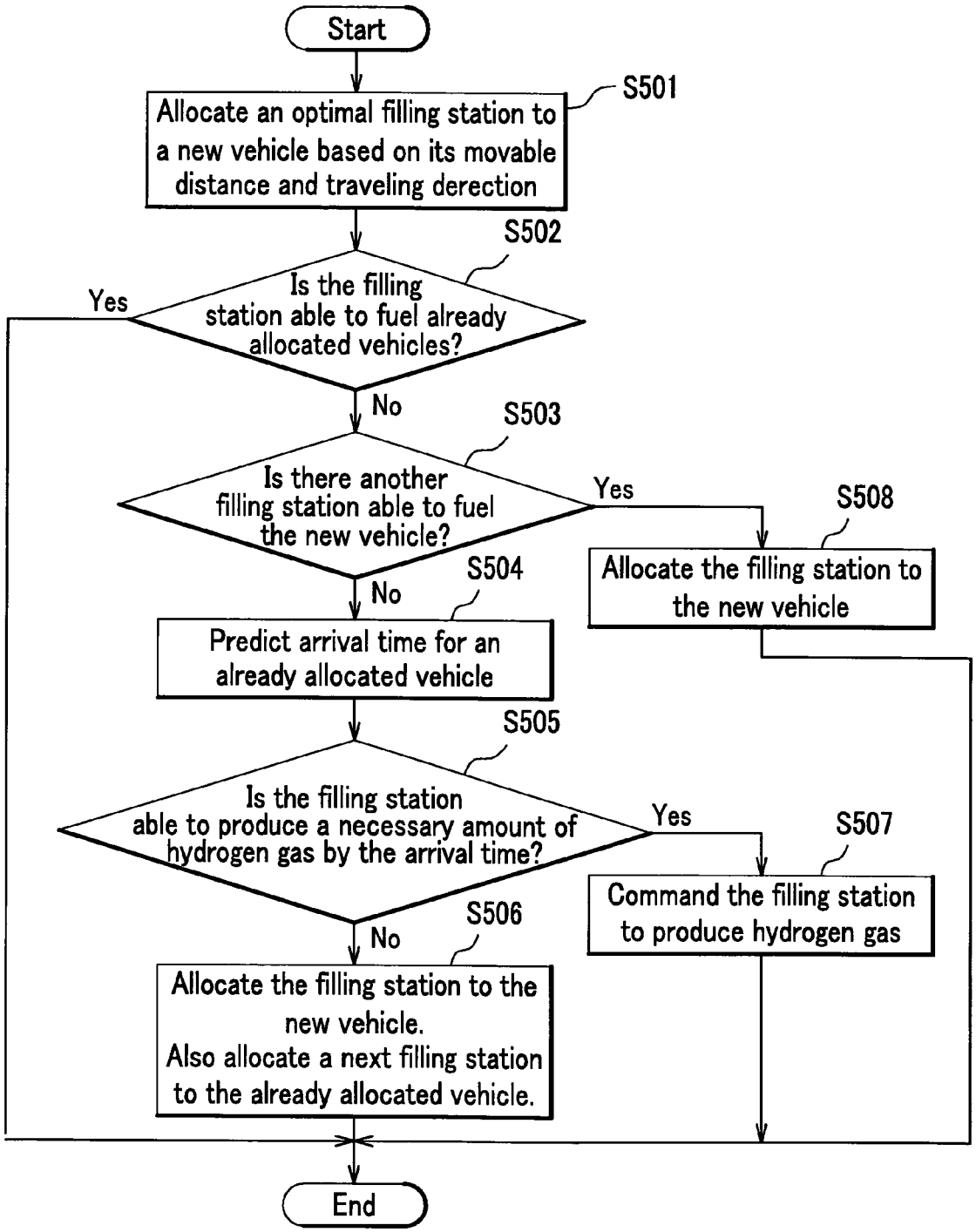
FIG. 5 is a flow chart showing steps carried out by a server according to the present invention so as to coordinate allocation of filling stations to vehicles.

FIG. 5 is a flow chart showing steps carried out by a server according to the first embodiment so as to allocate filling stations to vehicles. These steps, which correspond to broken-down elements of step S312 shown in FIG. 3, revalue existing allocation so that the server 3 prioritizes a vehicle 1 experiencing fuel shortage so as to allocate filling stations 2 to it. First, the server 3 allocates an optimal filling station 2 to a new vehicle 1 according to its movable distance and traveling direction (step S501). More specifically speaking, in the same manner as step S309 shown in FIG. 3 and steps S402 and S403 shown in FIG. 4, the server 3 calculates a movable distance for the new vehicle 1, and selects appropriate filling stations 2 which stand within a range of the movable distance. In this way, the server 3 allocates the optimal filling station 2 to the new vehicle 1, taking into account its traveling direction. In the steps described above, the server 3, which temporarily prioritizes the new vehicle 1, does not check an amount of stored fuel for each filling station 2. In case the amount of stored fuel is not sufficient, it may be possible for the server 3 to send a message commanding production of hydrogen gas to a filling station 2.

When the server 3 has assigned the new vehicle 1 to a filling station 2, it checks whether or not the filling station 2 is able to provide fuel to vehicles 1 which have already been assigned to the filling station 2 (step S502). This step is to confirm whether or not each of these vehicles 1 can have supply of a minimum amount of hydrogen gas. More specifically speaking, the server 3 reads out for the filling station 2 its amount of stored fuel from the data base 332. If this amount is not less than a total amount required for the new vehicle 1 and the other vehicles 1, which have already been assigned to the filling station 2, the server 3 determines that it is possible for the filling station 2 to provide fuel to both the new vehicle 1 and the other vehicles 1. If it is possible for the filling station 2 to provide fuel (YES in step S502), the server 3 finishes steps for coordinating allocation of filling stations to vehicles.

If it is not possible for the filling station 2 to provide fuel (NO in step S502), the server starts checking if there is another filling station 2 which is able to provide fuel to the new vehicle 1 (step S503). In this step the server 3, subsequent to step S501, investigates if there is any available filling station 2 for the new vehicle 1 while the server 3 checks an amount of stored fuel for filling stations 2 one after another, in order of their closeness with respect to a traveling direction of the new vehicle 1. If there is an available filling station 2 (YES in step S503), the server 3 allocates the filling station 2 to the new vehicle 1 (step S508). If there is not an available station 2 (NO in step S503), the server 3 conducts prediction of time (arrival time) for a vehicle 1, which has already been assigned to a filling station 2 (step S504). The server 3 predicts the arrival time based on vehicle information, such as geography and traffic congestion associated with the vehicle 1, which the server 3 reads out from the data base 331.

The server 3 checks whether or not the filling station 2 is able to produce a necessary amount of hydrogen gas by the arrival time predicted in step S504 (step S505). For this purpose, the server 3 determines if a predicted amount of production of hydrogen gas is equal to or greater than an amount of shortage of hydrogen gas. The predicted amount of production is obtained from a multiplication, a multiplicand of production capacity of a filling station 2, which is read out from the data base 332, and a multiplier of a period of time based on the arrival time. The amount of shortage is a subtraction, the total amount of hydrogen gas obtained in step S502 minus the amount of stored hydrogen gas. If the filling station 2 is able to produce the necessary amount of hydrogen gas (YES in step S505), the server 3 commands the filling station 2 to produce hydrogen gas (step S507).

More specifically speaking, the server 3 transmits a message commanding production of hydrogen gas to the filling station 2. Receiving this message, the filling station 2 produces hydrogen gas with a unit 22 for producing hydrogen gas (a fuel unit for producing fuel in the appended claims). If the filling station 2 is not able to produce the necessary amount of hydrogen gas (NO in step S505), the server 3 allocates not only the filling station 2 to the new vehicle 1, but also a next filling station 2 to a vehicle 1, to which the filling station 2 has already been allocated (step S506). This completes steps for coordinating allocation of filling stations.

Figure 6:
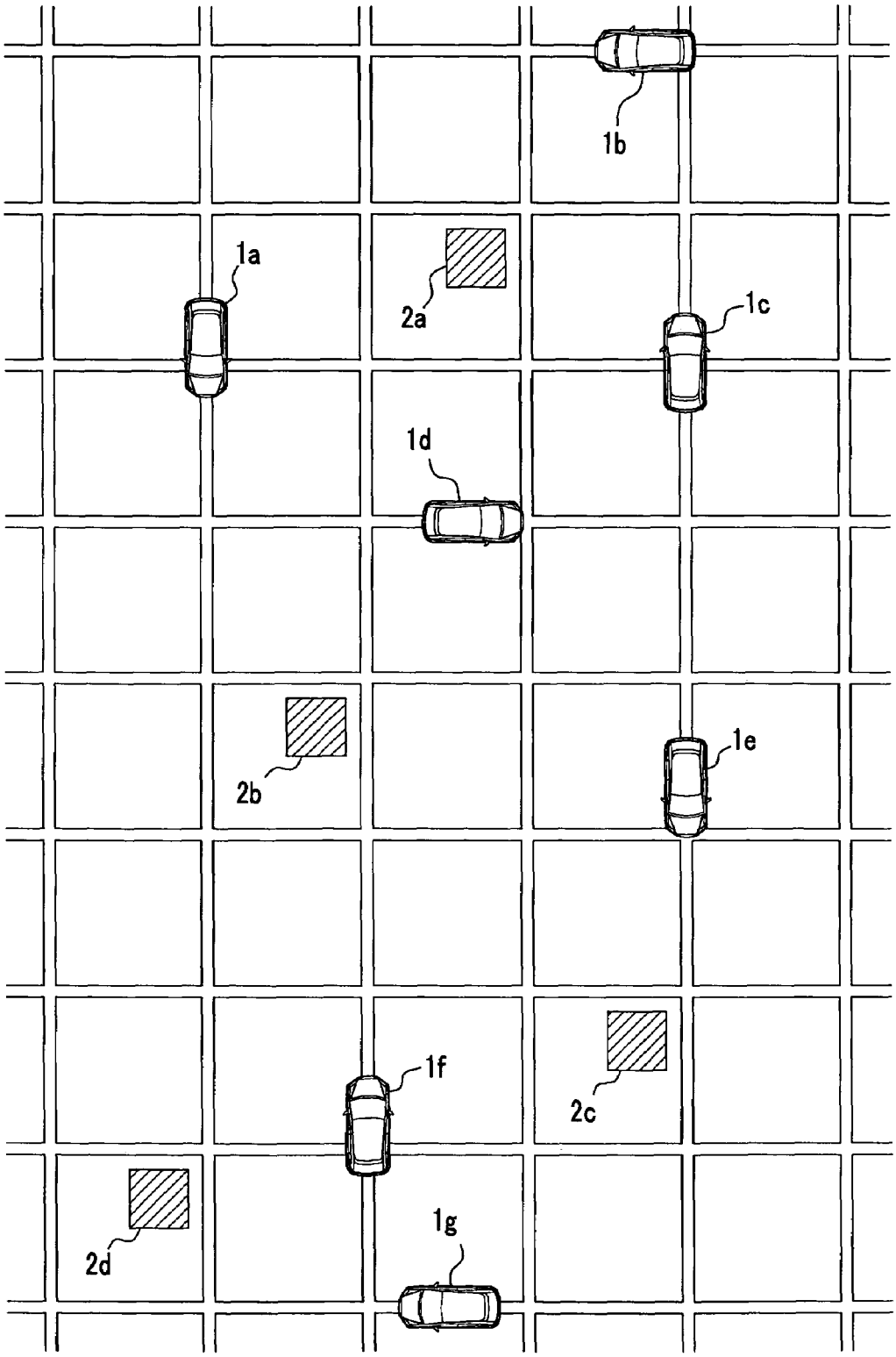
FIG. 6 is a map illustrating an example of spatial relationship between vehicles and filling stations.
Figure 7:
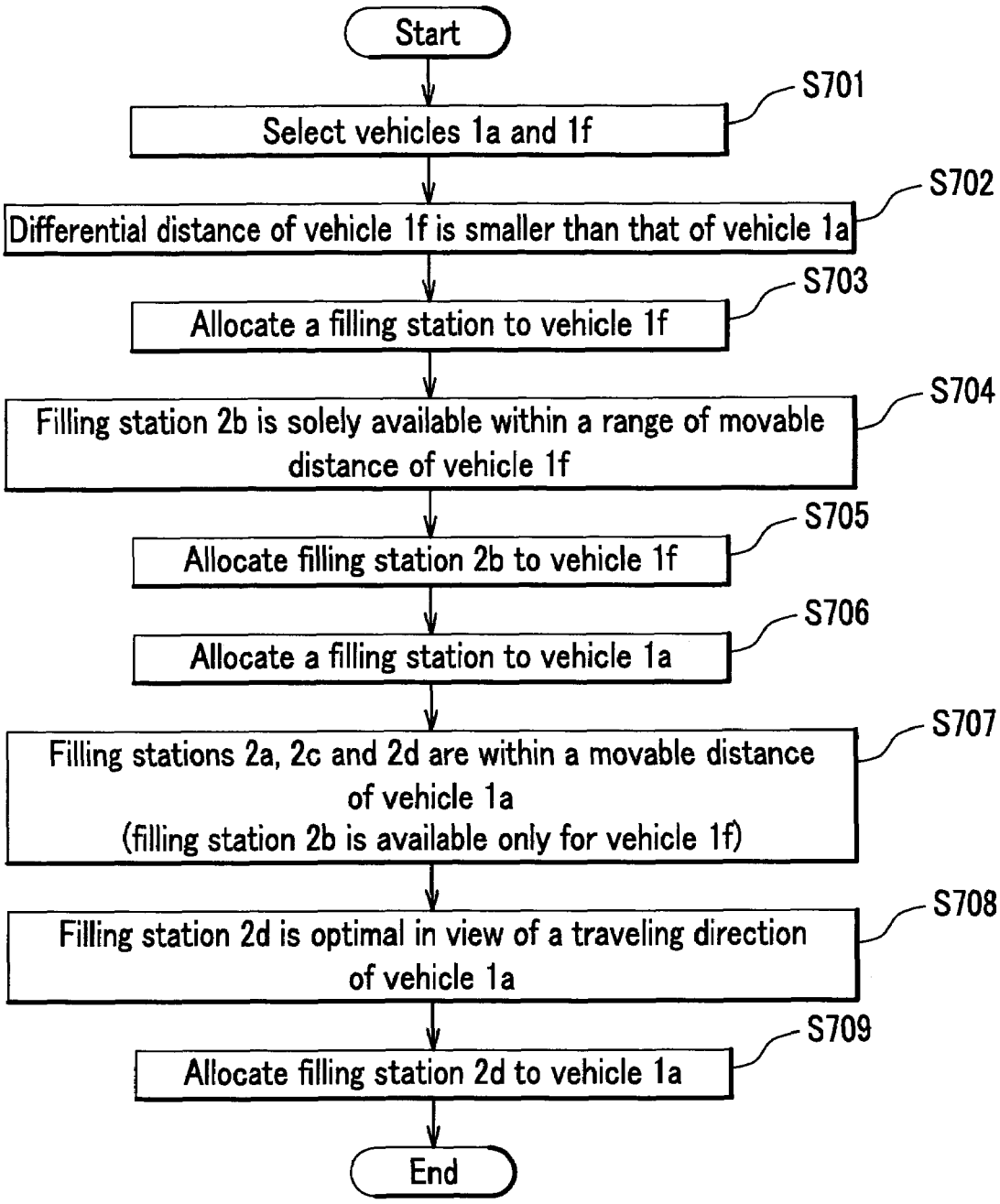
FIG. 7 is a flow chart showing an example of allocation of filling stations to two vehicles according to the present invention.
Figure 8:
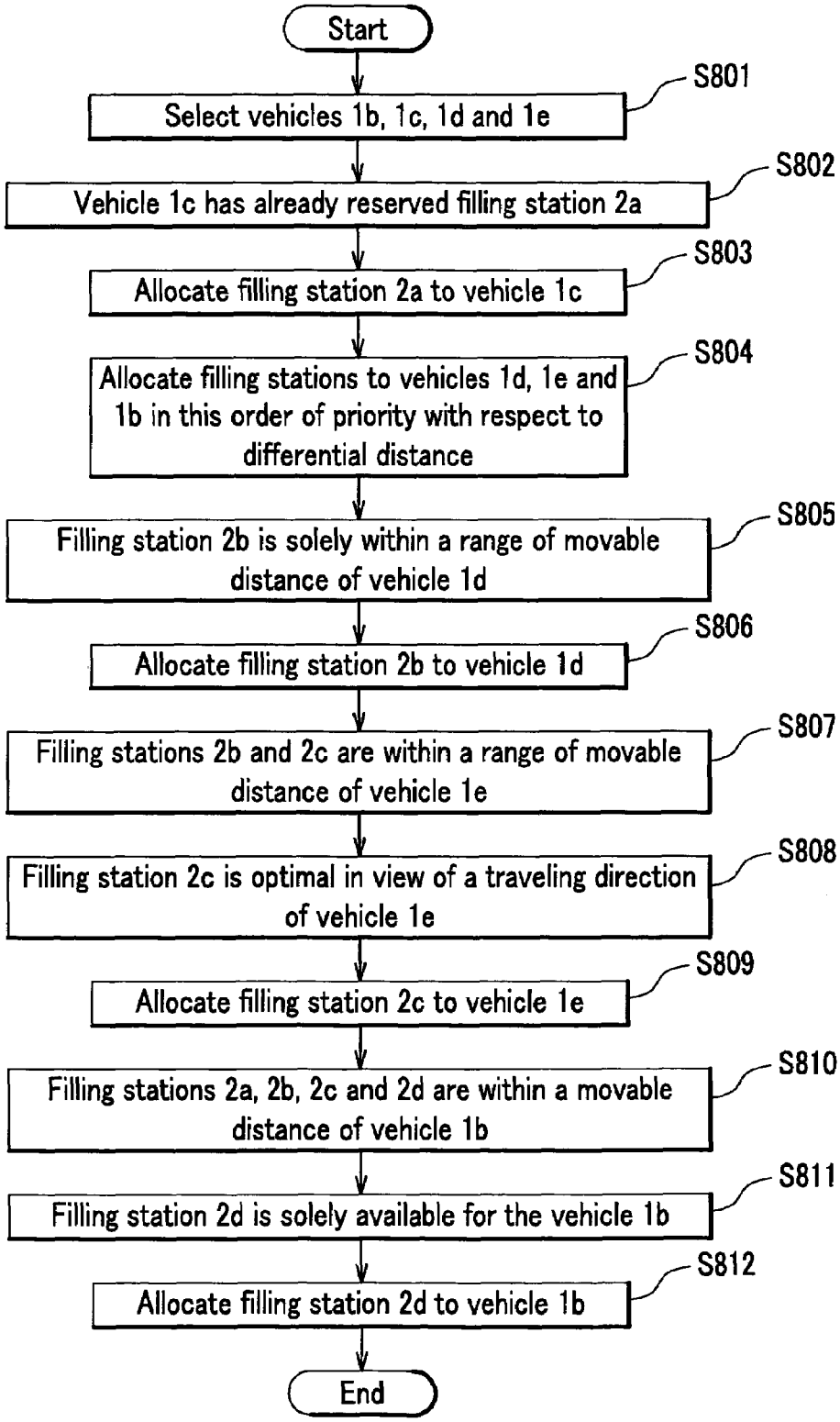
FIG. 8 is a flow chart showing an example of allocation of stations to four vehicles according to the present invention.
Figure 9:
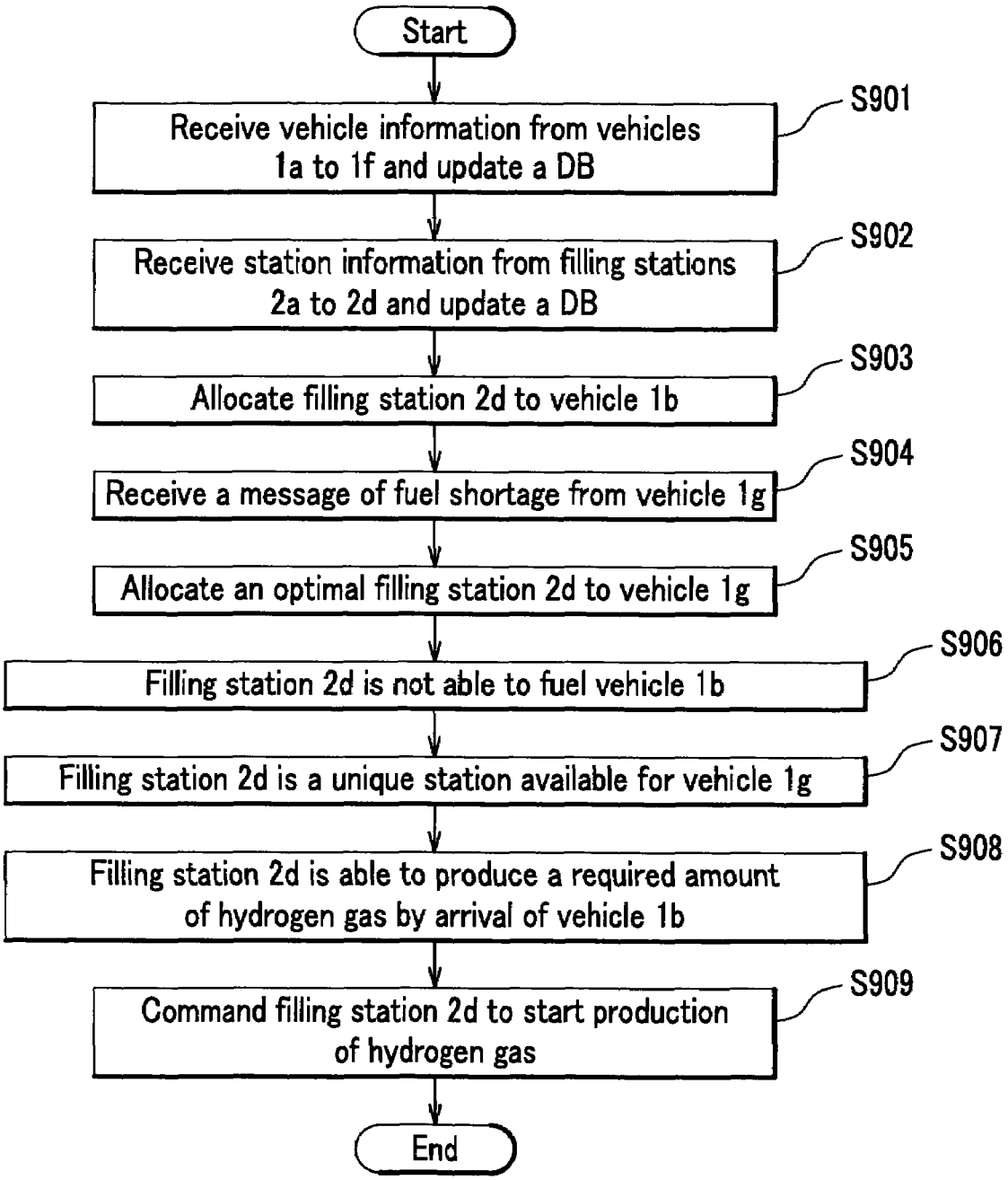
FIG. 9 is a flow chart showing an example of coordination after allocating stations to vehicles according to the present invention.

Description is given of an example, to which steps carried out by a system for allocating fuel stations to movable bodies are applied, with reference to FIGS. 6 to 9. As shown in FIG. 6, there are vehicles 1*a* to 1*g* (seven vehicles) and filling stations 2*a* to 2*d* (four filling stations) on the map. This map is representative of vehicle information, especially current positions of vehicles 1, which are received from the vehicles 1 and stored in the data base 331, and station information, especially positions of filling stations 2, which are received from the filling stations 2 and stored in the data base 332. Description is given of an example, in which allocation and coordination of filling stations to vehicles according to the first embodiment are carried out, with reference to FIGS. 7 to 9 as well as FIG. 6 (FIGS. 1 and 2 if necessary). In FIGS. 7 to 9, a larger box represents a step carrying out confirmation or determination, and a smaller box a step carrying out a settled processing.

A server 3 selects vehicles 1*a* and 1*f*, which require allocation of filling stations 2, as shown in FIG. 6 (step S701). Determining that a differential distance of the vehicle if is smaller than that of the vehicle 1*a* (step S702), the server 3 allocates a filling station 2 to the vehicle if (step S703). As the server 3 determines that only a filling station 2*b* is available, which is located within a range of movable distance of the vehicle 1*f* (step S704), the server 3 allocates the filling station 2*b* to the vehicle 1*f* (step S705).

Next, the server 3 allocates a filling station 2 to the vehicle 1*a* (step S706). The server 3 determines that only filling stations 2*a*, 2*c* and 2*d* are located within a movable distance of the vehicle 1*a* (step S707). It should be noted that taking into account its amount of stored fuel, the filling station 2*b* is excluded, which is not available for the vehicle 1*a* as a result of having already been allocated to the vehicle if. The server 3 determines that the filling station 2*d* is an optimal station in view of a traveling direction of the vehicle 1*a* (step S708). In this way, the server 3 allocates the filling station 2*d* to the vehicle 1*a* (step S709).

The server 3 selects vehicles 1*b*, 1*c*, 1*d* and 1*e*, which require allocation of filling stations 2, as shown in FIG. 6 (step S801). Confirming that the vehicle 1*c* has already reserved fueling at a filling station 2*a* (step S802), the server 3 allocates the filling station 2*a* to the vehicle 1*c* (step S803). Comparing movable distances for remaining vehicles 1, the server 3 allocates filling stations 2 to the vehicles 1*d*, 1*e* and 1*b* in this order of priority (step S804). Confirming that only a filling station 2*b* is located within a range of movable distance of the vehicle 1*d* (step S805), the server 3 allocates the filling station 2*b* to the vehicle 1*d* (step S806).

Next, the server 3 confirms that filling stations 2*b* and 2*c* are located within a range of movable distance of the vehicle 1*e* (step S807). The server 3 determines that the filling station 2*c* is an optimal station in view of a traveling direction of the vehicle 1*e* (step S808). In this way, the server 3 allocates the filling station 2*c* to the vehicle 1*e* (step S809). Subsequently, the server 3 confirms that the filling stations 2*a*, 2*b*, 2*c* and 2*d* are located within a movable distance of the vehicle 1*b* (step S810). Taking into account an amount of stored fuel, the server 3 determines that only the filling station 2*d* is available for the vehicle 1*b* (step S811). In this way, the server 3 allocates the filling station 2*d* to the vehicle 1*b* (step S812).

Receiving vehicle information transmitted by the vehicles 1*a* to 1*f*, the server 3 updates the data base 331 for vehicle information (step S901). Similarly, receiving station information transmitted by the filling stations 2*a* to 2*d*, the server 3 updates the data base 332 for station information (step S902). The server 3 allocates the filling station 2*d* to the vehicle 1*b*, which requires allocation of filling stations 2 (step S903). The server 3 afterward receives a message conveying fuel shortage from a new vehicle 1*g* (step S904), whose vehicle information the server 3 has not received in step S901. The server 3 assigns the vehicle 1*g* to the filling station 2*d*, which the server 3 has selected as an optimal station in view of a current position and traveling direction of the vehicle 1*g* (step S905).

However, the server 3 knows that the filling station 2*d* is not able to provide hydrogen gas to the vehicle 1*b*, which has been assigned to the filling station 2*d* in step S903, if the server 3 allocates the station 2*d* to the vehicle 1*g* (step S906). In addition, the server 3 knows that the filling station 2*d* is a unique station which is available for the vehicle 1*g* (step S907). The server 3 determines that the filling station 2*d* is able to produce a required amount of hydrogen gas by arrival of the vehicle 1*b*, as a result of carrying out an investigation (step S908). In this way, the server 3 transmits a message requesting the filling station 2*d* to start production of hydrogen gas, leaving the allocation of the station 2*d* to both vehicles 1*b* and 1*g* as it is (step S909).

b. SECOND EMBODIMENT

Description is given of a system for allocating fuel stations to movable bodies according to a second embodiment of the present invention. In comparison with the first embodiment, the second embodiment has structure similar to that of the first embodiment but has some different steps. Step S310 for allocating filling stations to vehicles and step S312 for coordinating the allocation, which are shown in FIG. 3, are different from those of the first embodiment. In the first embodiment, the server 3 allocates filling stations 2 to vehicles 1 based on movable distances and traveling directions of the vehicles 1. In contrast, the second embodiment takes into account a shortest route for a vehicle 1, which extends from its current position to destination, in addition to its movable distance. It may be alternatively possible to adopt a route which is selected by prediction based on geography and traffic congestion so as to allow the vehicle 1 to reach the destination in a shortest period of time. In the second embodiment, the server 3 not only allocates a filling station 2 to a plurality of vehicles 1, but also determines order of priority (fueling priority in the appended claims) for each vehicle 1 with regard to fueling carried out by the filling station 2. Description will be given of steps for allocating filling stations and coordinating the allocation. An example of application will be described afterward.

Figure 10:
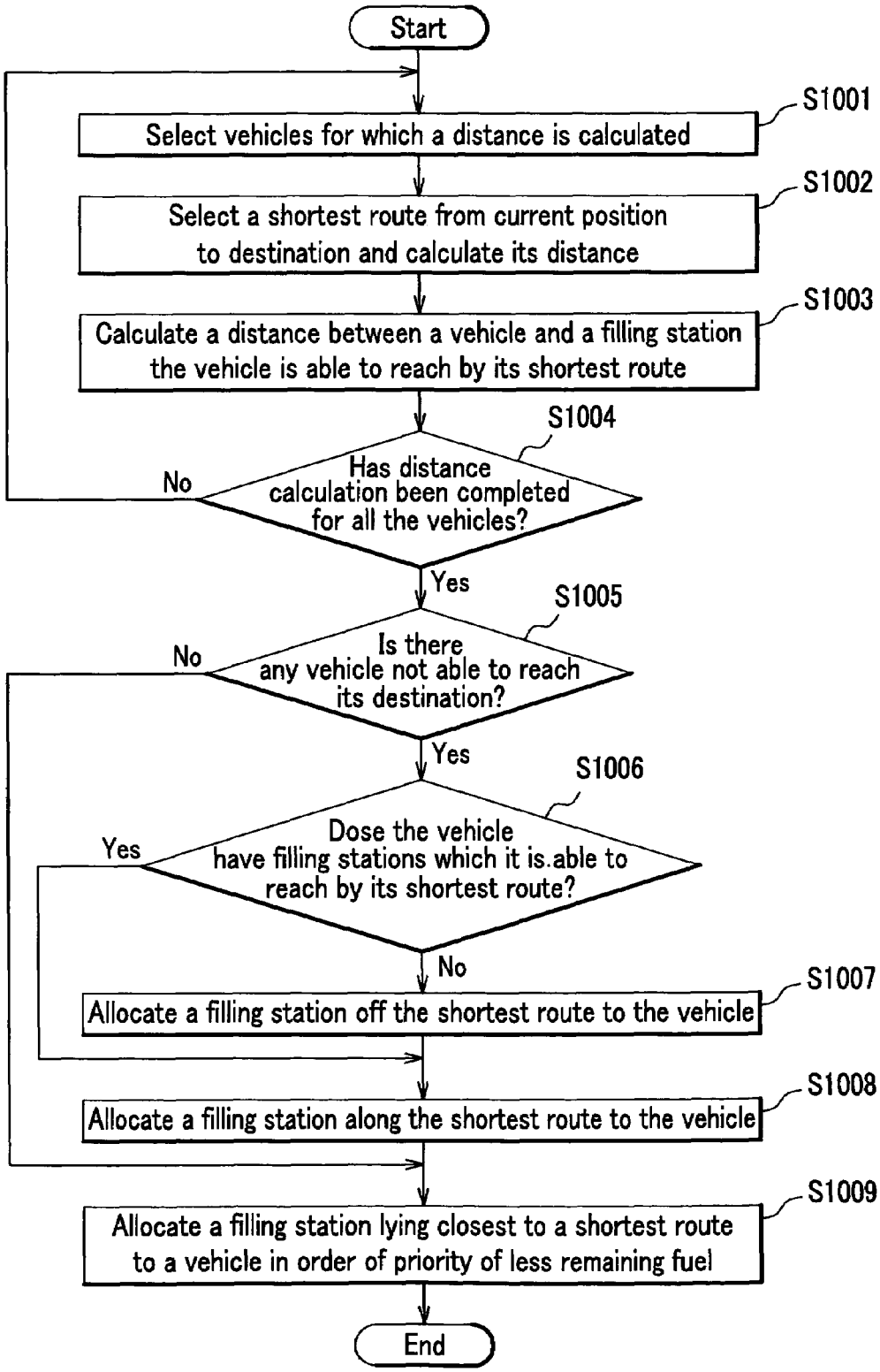
FIG. 10 is a flow chart showing steps applied to allocation of filling stations carried out by a server according to the present invention.

Description is given of steps which are carried out by a server for allocating filling stations according to the second embodiment with reference to FIG. 10, as well as FIGS. 1 and 2 if necessary. These steps, which detail a step for allocating filling stations in step S310 shown in FIG. 3, replace steps shown in FIG. 4. A server 3 selects vehicles 1, for which the server 3 carries out distance calculation (step S1001). The distance calculation is meant to represent a calculation, which is executed for each vehicle 1 in subsequent steps S1002 and S1003. It should be noted that in the second embodiment, the vehicles 1 are not those which have completed reservations for fueling at stations 2 (NO in step S307), but those selected afterward, which require allocation of filling stations 2 (step S309). The server 3 selects the vehicles 1 one after another, for which it carries out a distance calculation. In this connection, order for selection of a vehicle 1 is not limited as long as it is possible to carry out calculation without omission.

The server 3 selects a shortest route for a vehicle 1, which extends from its current position to destination, calculating a distance for the shortest route (S1002). More specifically speaking, the server 3 reads out the current position and destination of the vehicle 1 from a data base 331 for vehicle information in a memory unit 33. The server 3 reads out from the memory unit 33 map data, with which the server 3 searches for routes extending from the current position to destination, so that the server 3 extracts a shortest route. In this way, the server 3 calculates a distance for the shortest route.

Subsequently, the server 3 calculates a distance between the vehicle 1 and a filling station 2, which the vehicle 1 is able to reach with the shortest route selected in step S1002 (step S1003). More specifically speaking, the server 3 checks spatial relation between the shortest route and filling stations 2 located within a control area so as to determine whether or not each filling station 2 lies along the shortest route. The server 3 uses the following methods for determination, for example. Assuming a closest point (hereinafter referred to as point X) on the shortest route with respect to a filling station 2, the server 3 evaluates whether or not a distance between the point X and the station 2 is less than or equal to a certain value. It is possible for the server 3 to evaluate whether or not a rate, a distance between the point X and the filling station 2 to the distance of the shortest route described above, is less than or equal to a certain value. Also it is alternatively possible to evaluate based on both distance and rate. Subsequently, the server 3 calculates a distance between the vehicle 1 and the filling station 2 which is determined to lie along the shortest route. For this distance calculated by the server 3, it is possible to select either of the following two types of distances. One is a total distance, which is obtained by a summation, a distance between a current position of the vehicle 1 and the point X plus a distance between the point X and the filling station 2. The other one is a distance of the shortest route from a current position of the vehicle 1 to the filling station 2. It is possible for the server 3 to identify the filling station 2 which the vehicle 1 is able to reach by the shortest route. In this way, the server 3 is able to calculate the distance between the vehicle 1 and the filling station 2. Furthermore, comparing this distance with a movable distance of the vehicle 1, the server 3 knows whether or not the vehicle 1 is able to reach the filling station 2.

The server 3 determines whether or not it has completed distance calculation carried out in steps S1002 and S1003 for all the vehicles 1 which have been selected in step S1001 (step S1004). If not completed (NO in step S1004), the server 3 goes back to step S1001, where it carries out a calculation for a next vehicle 1. If completed (YES in step S1004), the server 3 moves on to step S1005.

The server 3 checks if there is a vehicle 1 which is not able to reach its destination (step S1005). This is carried out by checking whether or not a movable distance calculated in step S301 shown in FIG. 3 is equal to or greater than a distance of the shortest route calculated in step S1002. If there is a vehicle 1 (YES in step S1005), the server 3 investigates if the vehicle 1 has filling stations 2 which it is able to reach by the shortest route (step S1006). The server 3 incorporates results obtained in step S1003 in executing step S1006. If the vehicle 1 has not the filling stations 2 (NO in step S1006), the server 3 assigns the vehicle 1 to a filling station 2 which is off the shortest route (step S1007). In this connection, if there are plural filling stations 2 which the vehicle 1 is able to reach, namely which are within a movable distance of the vehicle 1, the server 3 allocates all of them to the vehicle 1. In this case where a filling station 2 is allocated to plural vehicles 1, the smaller a distance between the filling station 2 and a vehicle 1 is, the more highly the vehicle 1 is prioritized. The same criterion is applied to a next step S1008.

After step S1007 or if the vehicle 1 which cannot reach its destination has a filling station 2, which the vehicle 1 is able to reach by its shortest route (YES in step S1006), the server 3 allocates the filling station 2 to the vehicle 1 (step S1008). If there are plural filling stations 2 which the vehicle 1 is able to reach, the server 3 allocates all of them to the vehicle 1. If the server 3 knows after step S1007 that there is not a vehicle 1 which has a filling station 2, which the vehicle 1 is able to reach by its shortest route, the server 3 skips step S1008.

After step S1008 or if there is no vehicle 1 which is not able to reach its destination (NO in step S1005), the server 3 gives priority to a vehicle 1 with a small amount of remaining fuel among vehicles 1 which are able to reach their destinations. And the server 3 allocates a filling station 2 which lies closest to a shortest route of the vehicle 1 (step S1009). Although in this case it is possible to assign the vehicle 1 to plural filling stations 2, which the vehicle 1 is able to reach by its shortest route, the server 3 is adjusted to prioritize a closest filling station 2. In this connection, it is arranged that priority given to the vehicle 1 is not higher than that of vehicles 1 to which the filling station 2 has been allocated in steps S1007 and S1008. The reason for this lies in the fact that the allocation of the filling station 2 to the vehicle 1 with a small amount of remaining fuel which is able to reach its destination is just a step by way of precaution. Furthermore, if a filling station 2*a* is a unique one that a vehicle 1*a* is able to reach by its shortest route, the vehicle 1*a* is given higher priority in allocation of the filling station 2*a*, in comparison with a vehicle 1*b* which additionally has a filling station 2*b*, which the vehicle 1*b* is able to reach by its shortest route. If step S1008 has been completed and there is no vehicle 1 which is able to reach its destination, the server 3 skips step S1009.

Figure 11:
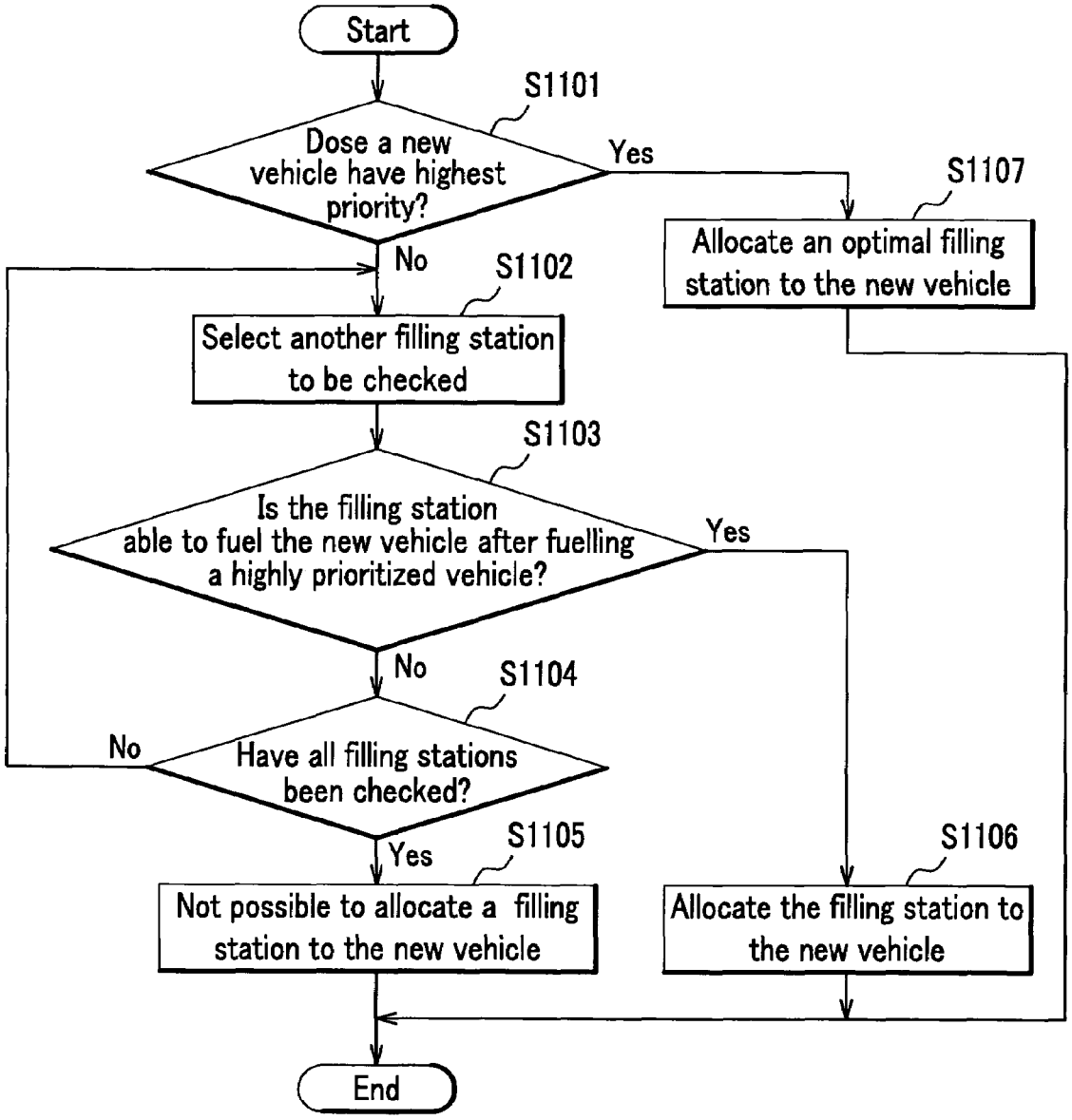
FIG. 11 is a flow chart showing steps carried out by a server so as to coordinate allocation of filling stations to vehicles according to the present invention.

Description is given of steps for coordinating allocation of filling stations carried out by a server according to the second embodiment with reference to a flow chart shown in FIG. 11, as well as FIGS. 1 and 2 if necessary. These steps, which detail step S312 shown in FIG. 3, replace steps shown in FIG. 5. The server 3 investigates whether or not a vehicle 1 newly coming into a control area has highest priority (step S1101). The priority, which is taken into account in step S1105 and its subsequent steps, is categorized into the following three levels. First priority is given to a vehicle 1 which is neither able to reach its destination nor has a filling station 2 that the vehicle 1 is able to reach by its shortest route. Second priority is given to a vehicle 1 which is not able to reach its destination but has a filling station 2 that the vehicle 1 is able to reach by its shortest route. Third priority is given to a vehicle 1 which is able to reach its destination and has a filling station 2 that the vehicle 1 is able to reach by its shortest route. In each of these levels of priority, the closer to a filling station 2 it is located or the smaller amount of remaining fuel it possesses, the higher priority is given to a vehicle 1. The server 3 carries out steps S1002 and S1003 shown in FIG. 10 for a new vehicle 1 so as to determine whether or not the new vehicle 1 has higher priority than any one of vehicles 1, which have been allocated a filling station 2.

If the new vehicle 1 does not have the highest priority (NO in step S1101), the server 3 selects another filling station 2 which is to be checked in a next step S1103 (step S1102). In doing this selection, for example, the server 3 gives priority to a filling station 2, which the new vehicle 1 is able to reach by its shortest route to a destination and which is closest to the new vehicle 1. The server 3 checks whether or not the filling station 2 is able to fuel the new vehicle 1 after fuelling a vehicle 1 which is given higher priority (step S1103). More specifically speaking, the server 3 checks if a difference, an amount of stored fuel of the filling station 2 minus a total amount of necessary fuel for vehicles 1 with higher priority, is equal to or more than a necessary amount of fuel for the new vehicle 1. If it is not possible (NO in step S1103), the server 3 confirms if all filling stations 2 have been checked (step S1104). If there is an unchecked filling station 2 (NO in step S1104), the server 3 goes back to step S1102 so as to continue checking. If all the filling stations 2 have been checked (YES in step S1104), it is concluded that there is no filling station 2 available for the new vehicle 1, namely it is not possible for the server 3 to allocate a filling station 2 to the new vehicle 1 (step S1105).

If it is possible to fuel the new vehicle 1 (YES in step S1103), the server 3 allocates the filling station 2 to the new vehicle 1 (step S1106). If the new vehicle 1 has highest priority (YES in step S1101), the server 3 allocates an optimal filling station 2 to the new vehicle 1 (step S1107). The optimal filling station 2 is meant to represent a closest filling station 2 which the new vehicle 1 is able to reach by its shortest route to a destination or a closest filling station 2 which is off the shortest route. It is understood that if the server 3 allocates a filling station 2 to the new vehicle 1 in step S1106 or steps S1107, the server 3 downgrades priority of a vehicle 1 by one, which is lower than that of the new vehicle 1.

Figure 12:
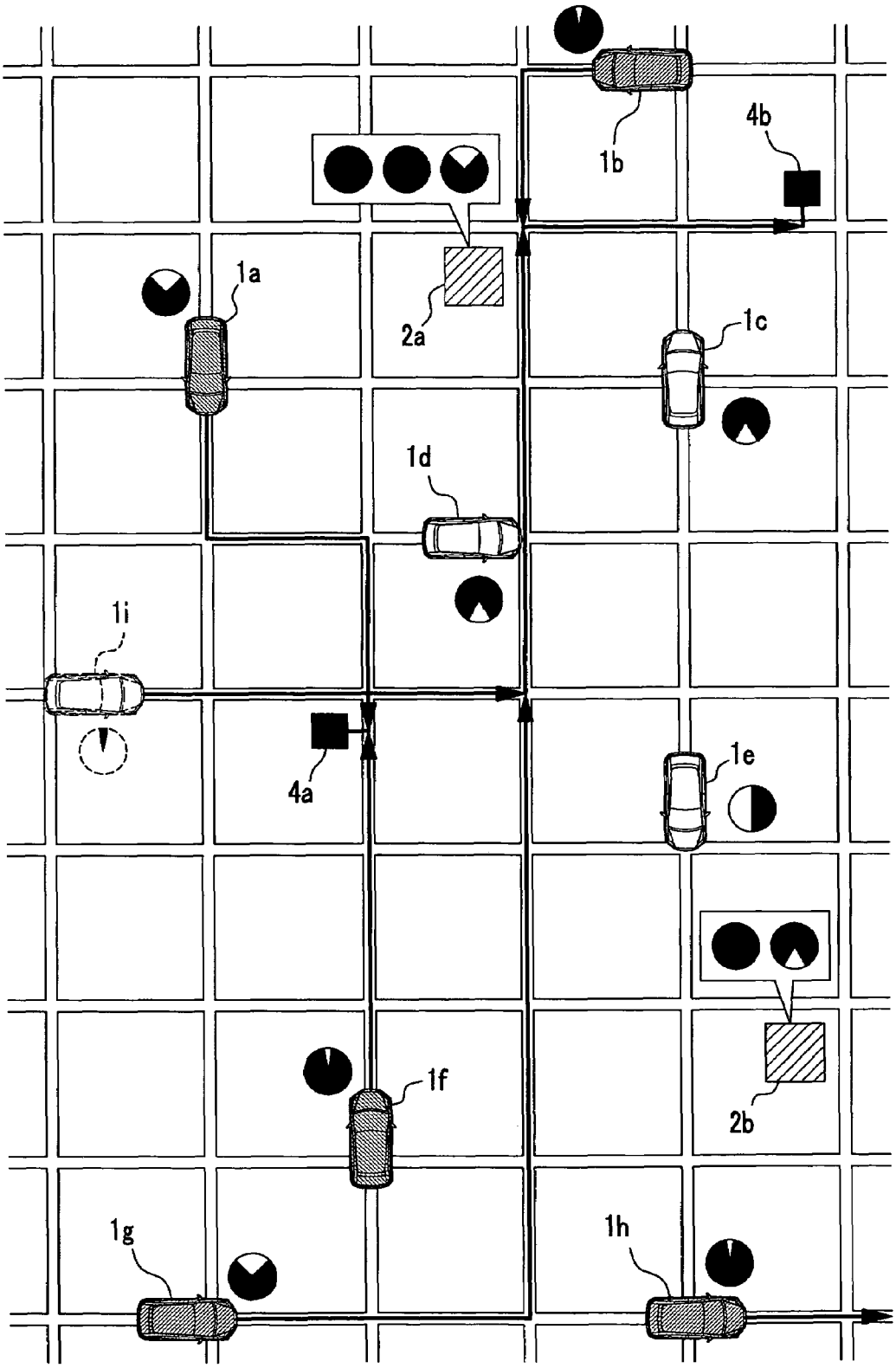
FIG. 12 is a map illustrating spatial relation among vehicles, filling stations and destinations.

Description is given of an example of application of steps which are carried out by a system for allocating fuel stations to movable bodies described above with reference to FIGS. 12 and 13. As shown in FIG. 12, vehicles 1*a* to 1*g* (seven hydrogen vehicle), filling stations 2*a* and 2*b* (two hydrogen gas stations) and destinations 4*a* and 4*b* (two destinations) are on the map. This map is representative of vehicle information, especially current positions and destinations of vehicles 1, which are received from the vehicles 1 and stored in a data base 331, and station information, especially positions of filling stations 2, which are received from the filling stations 2 and stored in a data base 332.

Circular graphs, which indicate status of a vehicle 1 and a filling station 2, illustrate an amount of remaining fuel of the vehicle 1 and an amount of stored fuel of the filling station 2, respectively. One circular graph corresponds to one vehicle 1, a black portion illustrating an amount of fuel and a white portion illustrating a consumed amount. A solid line with an arrow, which connects a vehicle 1 and a destination 4, indicates that the destination 4 belongs to the vehicle 1 and a route shown by the solid line represents a shortest route to the destination 4. As shown in FIG. 12, the vehicles 1*a* and if have a destination 4*a*. Similarly, the vehicles 1*b* and 1*g* have a destination 4*b*. As a destination of the vehicle 1*h* is not within a control area of the server 3, only a portion of its shortest route which lies within the control area is shown by a solid line with an arrow.

Figure 13:
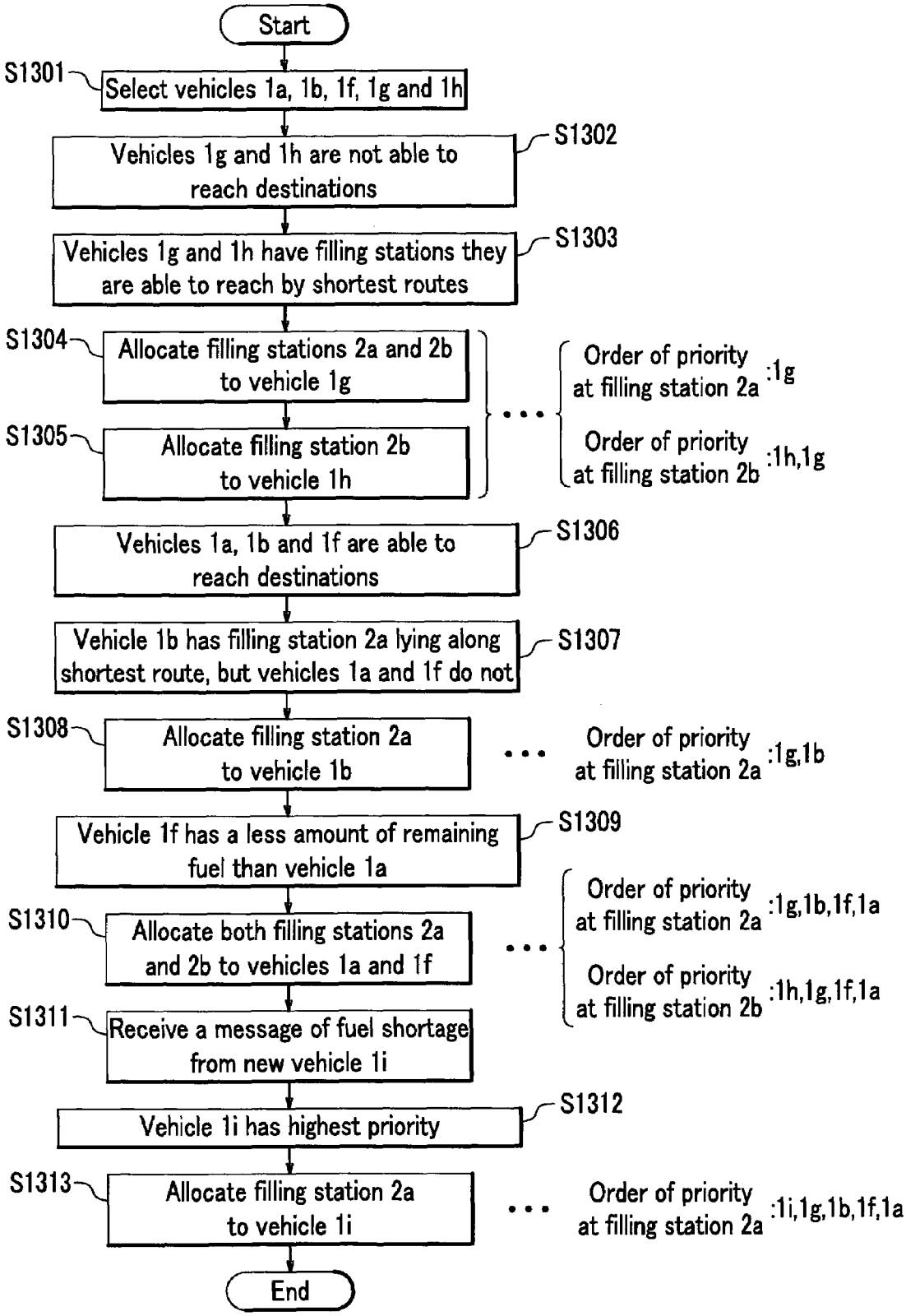
FIG. 13 is a flow chart showing an example of allocation of stations to vehicles and its coordination.

Description is given of an example of application of steps for allocating filling stations to vehicles and coordinating the allocation with reference to FIG. 13, as well as FIGS. 1, 2 and 12 if necessary. In FIG. 13, a larger box represents a step carrying out confirmation or determination, and a smaller box represents a step carrying out a settled processing. In addition, order of priority for vehicles 1 at a filling station 2 is attached to a box, in which allocation of the filling station 2 is carried out.

The server 3 selects vehicles 1*a*, 1*b*, 1*f*, 1*g* and 1*h* as vehicles requiring allocation of filling stations 2 (step S1301). As shown in FIG. 12, selected vehicles 1 are distinguished with hatching. In contrast, vehicles 1*c*, 1*d* and 1*e*, which do not need allocation of filling stations 2, are simply shown with white color. Under these conditions, if all the selected vehicles 1 approach the filling station 2*a*, it may cause shortage of fuel at the filling station 2*a*. This necessitates appropriate allocation of filling stations 2 carried out by the server 3.

The server 3 determines that the vehicles 1*g* and 1*h* are not able to reach a destination among the selected vehicles 1, taking into account an amount of remaining fuel (step S1302). The server knows that the vehicles 1*g* and 1*h* have filling stations 2 which they are able to reach by their shortest routes (step S1303). A criterion for whether a filling station 2 lies along a shortest route employs a distance between the filling station 2 and a point X. If the distance is within two blocks, for example, the server 3 determines that it lies along a shortest route. The server 3 allocates the filling stations 2*a* and 2*b* to the vehicle 1*g* (step S1304). The server 3 allocates the filling station 2*b* to the vehicle 1*h* (step S1305). In this case, order of priority is arranged in such a manner that the vehicle 1*g* has highest priority at the filling station 2*a*, and the vehicle 1*h* is given higher priority than the vehicle 1*g* at the filling station 2*b*. The reason why the vehicle 1*h* has higher priority than the vehicle 1*g* is that a distance between the filling station 2*b* and the vehicle 1*h* is smaller than that between the filling station 2*b* and the vehicle 1*g*.

The server 3 knows that the vehicles 1*a*, 1*b* and 1*f* are able to reach their destinations (step S1306). The server 3 also knows that the vehicle 1*b* has the filling station 2*a* which lies along the shortest route, but the vehicles 1*a* and 1*f* do not have such filling stations 2 (step S1307). Accordingly, the server 3 allocates the filling station 2*a* to the vehicle 1*b* (step S1308). In this case, the server 3 settles order of priority, the vehicle 1*g* first and the vehicle 1*b* second at the filling station 2*a*. The server 3 knows that between other vehicles 1*f* and 1*a*, the vehicle 1*f* has a less amount of remaining fuel than the vehicle 1*a* (step S1309). The server 3 accordingly allocates both the filling stations 2*a* and 2*b* to the vehicles 1*a* and 1*f*, respectively (step S1310), settling the following order of priority: the vehicle 1*f* first and the vehicle 1*a* second. In this case the server 3 settles the following order of priority at the filling station 2*a*: the vehicle 1*g* first, 1*b* second, 1*f* third and 1*a* fourth. Similarly, at the filling station 2*b*: the vehicle 1*h* first, 1*g* second, 1*f* third and 1*a* fourth.

The server 3 afterward receives a message conveying fuel shortage from a new vehicle 1*i*, from which the server 3 has not yet received its vehicle information (in step S302 of FIG. 3) (step S1311). In this case, it is understood that the vehicle 1*i* has highest priority (step S1312). The reason for this is twofold that the vehicle 1*i*, which is traveling to the destination 3*b*, is not able to reach there with its current amount of remaining fuel, and the vehicle 1*i* is located closer to the filling station 2*a* than the vehicle 1*g*, which is under the similar conditions as the vehicle 1*i*. Accordingly, the server 3 allocates the filling station 2*a* to the new vehicle 1*i* (step S1313). The server settles the following order of priority at the station 2*a*: the vehicle 1*i* first, 1*g* second, 1*b* third, 1*f* fourth and 1*a* fifth In this connection, it may be possible to fuel the vehicle 1*d*, which visits the filling station 2*a* in spite of a sufficient amount of remaining fuel, if the filling station 2*a* has sufficient stored fuel after fueling other vehicles 1, which have been already assigned to the filling station 2*a*. Otherwise, it is not possible for the filling station 2*a* to fuel the vehicle 1*d*.

As described above, a system for allocating fuel stations to movable bodies according to the present invention brings about the following advantages. The system allocates filling stations 2, which have a necessary amount of stored fuel, to vehicles 1 requiring supply of hydrogen gas. In this way, it is possible for the system to eliminate uneasiness of a driver for fuel shortage so as to let him feel assured and relived in driving. The system is able to realize this even if an infrastructure has not been sufficiently developed, which is made of small-scale filling stations. Furthermore, because the system is able to minimize an amount of hydrogen gas in terms of storage and production, it is possible to anticipate an effect of energy saving.

Because the system is able to receive vehicle information from plural vehicles 1, it is possible to provide reliable fueling through coordination for the vehicles 1. Similarly, because the system is able to receive station information from plural filling stations 2, it is possible to select an optimal station. For example, it is possible to select a filling station, which lies along or near a traveling direction of a vehicle 1.

Furthermore, because the system allocates a filling station 2 to a vehicle 1, taking into account a current position of the vehicle 1 to its destination, it is possible to fuel the vehicle 1 without requesting it to make a detour. In this way, it is possible to remove annoyance from a driver of the vehicle 1 as much as possible that he must visit a filling station 2, which is located off a route to its destination. Because the system settles order of priority for vehicles 1, which are assigned to a filling station 2, a driver is able to concentrate on driving a vehicle without paying attention to capacity of nearby filling stations 2. The reason for this lies in the fact that the system is able to prevent a vehicle 1 with lower priority from being fueled so as not to provide more fuel than necessary. In this way, because it is possible for a vehicle 1 with higher priority to avoid losing a chance of fuelling, the system will develop confidence of a driver.

While the invention has been described in detail and with reference to specific embodiments thereof, it will be apparent to one skilled in the art that various changes and modifications can be made therein without departing from the spirit and scope thereof. Following are examples of the modifications.

In the embodiment described above, the server 3 transmits a message alarming fuel shortage when the number of the filling stations 2 allocated to the vehicle 1 is less than (or less than or equal to) the predetermined threshold. The present invention is not limited to this. It may be alternatively possible that the vehicle 1, which has received allocation of filling stations, determines whether or not the number of allocated stations 2 is less than (or less than or equal to) the threshold, turning on an alarming light for fuel shortage. This will not only lighten a load of processing for the server 3, but also save an amount of data communication for the communication network 4.

In the embodiment described above, the server 3 receives vehicle and station information, in response to request for the information, which the server 3 transmits to the vehicles 1 and filling stations 2 in its control area. The present invention is not limited to this. For example, it may be alternatively possible for the vehicles 1 and filling stations 2 to transmit the vehicle and station information, respectively, in the control area covered by the server 3 at certain time intervals. In this way, a driver of a vehicle 1 is able to receive service provided by the server 3 lying in the area, though the server 3 does not transmit a request. In addition, this is able to decrease an amount of data communication of the communication networks 4 and 5.

In the embodiment described above, hydrogen gas is selected as an example of fuel. The present invention is not limited to this. It may be alternatively possible to apply the invention to other fuels, gasoline, light oil and natural gas, for example.

Although a vehicle is selected as a movable body in the embodiment described above, the present invention is not limited to this. It may be alternatively possible to apply the present invention to other movable bodies, a vessel and air plane, for example.

When a vehicle 1 displays filling stations 2 allocated by the server 3, it may be alternatively possible to show order of priority for the vehicles 1 at a station 2. In this connection, it may be possible to show the order of priority by numbers or icons symbolizing it. Because a driver visits a filling station 2, at which the vehicle 1 is given higher priority, the driver will be provided with fueling more reliably. In this way, the driver feels more at ease in driving. Furthermore, because the filling station 2 with higher priority is located near a route extending from a current position of the vehicle 1 to its destination, the driver will be provided with fueling more conveniently.

Foreign priority documents, JP 2004-307700 filed on Oct. 22, 2004 and JP2005-070836 filed on Mar. 14, 2005 are hereby incorporated by reference.

What is claimed is:

1. A system for allocating fuel stations to movable bodies comprising:

an onboard unit which is mounted on a movable body, the onboard unit storing and updating information about the movable body;

a station unit disposed at a fuel station which supplies fuel to the movable body, the station unit storing and updating information about the fuel station; and a server which is connected to the onboard unit and the station unit through networks, the server allocating certain fuel stations to the movable body which requires fueling, based on the information about the movable body received from the onboard unit and the information about the fuel station received from the station unit;

wherein the information about the movable body comprises an amount of remaining fuel and a position of the movable body, wherein the information about the fuel station comprises an amount of stored fuel and a position of the fuel station, wherein the server calculates not only a movable distance for the movable body based on information comprising the amount of remaining fuel, but also a station distance, which represents a distance between the movable body and the fuel station, based on the positions of the movable body and the fuel station, and wherein when a difference of distance resulting from a subtraction, the movable distance minus the station distance, is smaller than a certain threshold, the server determines a necessity of supplying fuel to the movable body, allocating a fuel station which keeps an amount of stored fuel necessary for fuelling the movable body.

2. A system according to claim 1, further comprising a display unit:

wherein the server transmits information about allocation of the fuel station to the onboard unit, and wherein the onboard unit is connected to the display unit, and when the onboard unit receives the information from the server, the onboard unit indicates the information on the display unit.

3. A system according to claim 2, wherein when number of fuel stations which the server allocates to the movable body is smaller than a certain threshold, the onboard unit indicates an alarm for fuel shortage on the display unit.

4. A system according to claim 1, further comprising a fuel unit for producing fuel:

wherein when the server is not able to allocate the fuel station which keeps the amount of stored fuel necessary for fuelling the movable body whereas the difference of distance is smaller than the certain threshold, the server transmits a message commanding production of fuel to the station unit, and wherein the station unit is connected to the fuel unit, and when the station unit receives the message from the server, the station unit starts the fuel unit for producing fuel.

5. A system according to claim 1, wherein the information about the movable body further comprises a destination of the movable body, and wherein the server searches for a route extending from a position of the movable body to a destination thereof, so that the server not only allocates one or more fuel stations to the movable body based on the route, a distance of the route, the position of the fuel station and the movable distance, but also settles order of priority for fueling the movable body at each fuel station.

6. A system according to claim 1 further comprising a display unit, wherein the display unit is connected to the onboard unit mounted on the movable body, and displays one of an alarm for fuel shortage and information about allocation of a fuel station which the onboard unit has received from the server.

* * * * *